US007404495B2

(12) United States Patent
Keung

(10) Patent No.: US 7,404,495 B2
(45) **Date of Patent: *Jul. 29, 2008**

(54) CHILD-RESISTANT FLIP-TOP DISPENSING CLOSURE AND PACKAGE

(75) Inventor: Wing-Kwong Keung, Perrysburg, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 466 days.

This patent is subject to a terminal disclaimer.

(21) Appl. No.: 10/628,521

(22) Filed: Jul. 28, 2003

(65) Prior Publication Data

US 2005/0023285 A1 Feb. 3, 2005

(51) Int. Cl.

| | |
|---|---|
| ***B65D 39/00*** | (2006.01) |
| ***B65D 43/04*** | (2006.01) |
| ***B65D 51/04*** | (2006.01) |
| ***B65D 47/00*** | (2006.01) |
| ***B67B 5/00*** | (2006.01) |

(52) U.S. Cl. ..... 215/237; 215/216; 215/235; 215/217; 215/221; 220/281; 220/839; 222/153.14; 222/546; 222/556

(58) Field of Classification Search ..... 215/204, 215/224, 216, 217, 219, 221, 237, 201, 218, 215/220, 206, 235; 222/107, 153.14, 556, 222/546, 153.1, 153.04; 220/281, 283, 839, 220/835, 324

See application file for complete search history.

(56) References Cited

U.S. PATENT DOCUMENTS

| | | | | | |
|---|---|---|---|---|---|
| 3,623,622 | A | * | 11/1971 | Sullivan | 215/213 |
| 4,170,315 | A | * | 10/1979 | Dubach et al. | 220/281 |
| 4,244,495 | A | | 1/1981 | Lorsheid et al. | |
| 4,353,483 | A | | 10/1982 | Pehr | |
| 4,424,910 | A | * | 1/1984 | Heinol | 215/216 |
| 4,429,800 | A | * | 2/1984 | Greenspan | 215/216 |
| 4,629,081 | A | * | 12/1986 | McLaren | 215/206 |
| 4,638,916 | A | | 1/1987 | Beck et al. | |
| 4,852,770 | A | * | 8/1989 | Sledge et al. | 222/153.14 |

(Continued)

FOREIGN PATENT DOCUMENTS

| | | |
|---|---|---|
| JP | 09142511 | 6/1997 |

(Continued)

*Primary Examiner*—Robin Hylton
(74) *Attorney, Agent, or Firm*—Reising, Ethington, Barnes, Kisselle, P.C.

(57) ABSTRACT

A child-resistant dispensing closure includes a base having a deck with a dispensing opening and a peripheral skirt. A lid is integrally molded with the base and coupled by a hinge to a periphery of the base so as to be pivotable between closed and open positions. One of the base and the lid has a latch arm resiliently extending from its periphery diametrically opposite the hinge. The latch arm has a pair of oppositely extending tabs adjacent to a free end of the arm. The other of the base and the lid has an axial passage for receiving the latch arm, and a pair of laterally spaced ledges in the passage for engagement by the tabs to lock the lid in the closed position. The latch arm is directly manually engageable by a user from a radial direction external to the closure to pivot the latch arm radially inwardly within the passage and release the tabs from the ledges so that the lid can be pivoted to the open position.

22 Claims, 5 Drawing Sheets

U.S. PATENT DOCUMENTS 4,892,208 A 1/1990 Sledge
5,083,671 A 1/1992 Hayes
5,137,260 A 8/1992 Pehr
5,332,131 A 7/1994 Pehr
5,356,017 A 10/1994 Rohr et al.
5,423,442 A * 6/1995 Nozawa et al. ..... 215/235
5,462,183 A 10/1995 Rohr et al.
5,489,035 A 2/1996 Fuchs
5,579,957 A 12/1996 Gentile et al.
5,628,533 A 5/1997 Hill
5,718,347 A 2/1998 Walker et al.
5,979,681 A * 11/1999 PatrickJean-Luc Andre et al. ..... 215/216
2007/0125741 A1 * 6/2007 Keung ..... 215/237

FOREIGN PATENT DOCUMENTS

JP 2003104429 4/2003

* cited by examiner

CHILD-RESISTANT FLIP-TOP DISPENSING CLOSURE AND PACKAGE

The present invention is directed to hinged flip-top dispensing closures and packages, and more particularly to provision of a child-resistance feature on such a closure and package.

BACKGROUND AND SUMMARY OF THE INVENTION

U.S. Pat. Nos. 4,638,916 and 5,489,035 disclose dispensing closures of one-piece integrally molded plastic construction. These closures include a base with a dispensing opening and an internally threaded skirt for securement to a container finish. A lid is integrally connected by a hinge to the periphery of the base. It is a general object of the present invention to provide a dispensing closure of this type having a feature that resists opening by a child.

A child-resistant dispensing closure in accordance with a first aspect of the present invention includes a base having a deck with a dispensing opening and a peripheral skirt. A lid is integrally molded with the base and coupled by a hinge to the base so as to be pivotable between closed and open positions. One of the base and the lid has a latch arm resiliently extending from its periphery diametrically opposite the hinge. The latch arm has a pair of oppositely extending tabs adjacent to a free end of the arm. The other of the base and the lid has an axial passage for receiving the latch arm, and a pair of laterally spaced ledges in the passage for engagement by the tabs to lock the lid in the closed position. The latch arm is directly manually engageable by a user from a radial direction external to the closure to pivot the latch arm radially inwardly within the passage and release the tabs from the ledges so that the lid can be pivoted to the open position.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
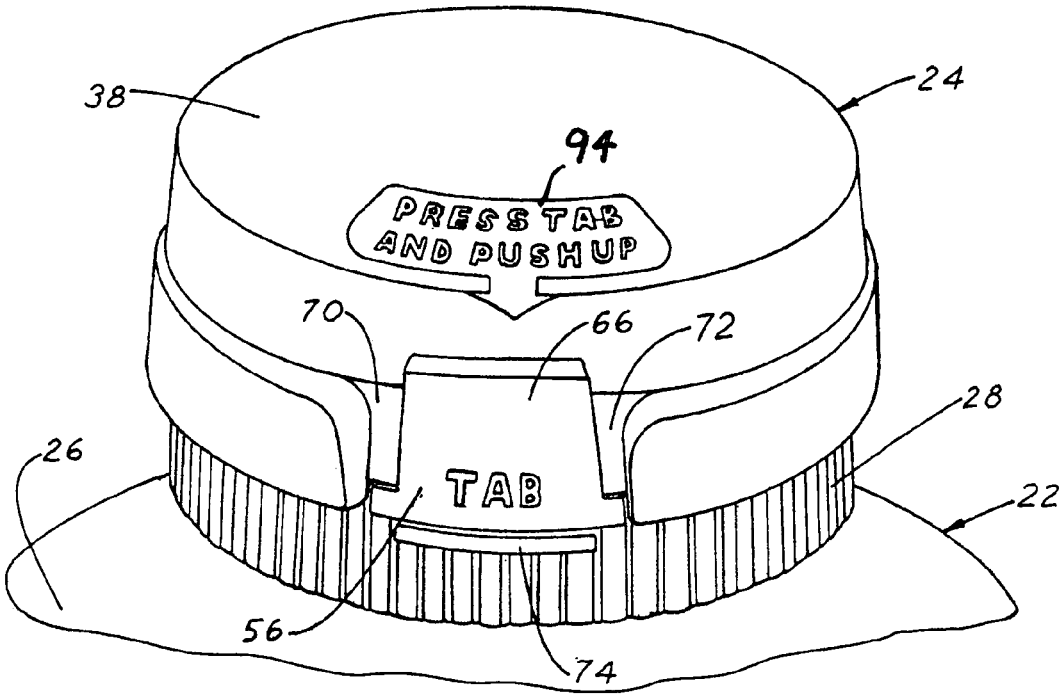
FIG. 1 is a fragmentary perspective view of a child-resistant closure and container package in accordance with one presently preferred embodiment of the invention.

FIG. 1 illustrates a child-resistant closure and container package 20 in accordance with one presently preferred embodiment of the invention as comprising a container 22 and a dispensing closure 24 secured to the container finish. Container 22 has a body 26 of flexible resilient construction, preferably molded plastic construction, that may be squeezed by a user to dispense product through closure 24 from within the container. Referring to FIGS. 1-8, closure 24 includes a base 28 having a deck 30 and a peripheral skirt 32. Skirt 32 has one or more internal threads or beads 34 for securement over one or more external threads or beads on the finish of container 22. A discharge or dispensing opening 36 is formed in deck 30, preferably although not necessarily by an annular upwardly extending wall. (Directional words such as "upward" and "downward" are employed by way of description and not limitation with respect to the upright orientation of the package and closure illustrated, for example, in FIGS. 1-2 and 4-6. Directional words such as "radial," "axial" and "lateral" are employed by way of description and not limitation with respect to the central axis of the closure skirt.) A cover or lid 38 is coupled to base 28 by a hinge 40 that extends between lid 38 and base 28, preferably but not necessarily between the periphery of lid 38 and the periphery of base 28. Closure 24, including base 28 and lid 38, preferably is of integrally molded plastic construction. In the embodiment of closure 24 illustrated in FIGS. 3-8, an annular wall 42 extends from the base wall 44 of lid 38 for plug-sealing engagement within dispensing opening 32 in the closed position of lid 38 overlying deck 30 of base 28.

In the particular embodiment of closure 24 illustrated in FIGS. 1-8, lid 38 has a base wall 44 and a peripheral skirt 46. A bead 48 extends around the inside surface of lid skirt 46 for sealing engagement with a radially outwardly facing surface 50 on base 28, which forms an axially facing ledge 52 recessed beneath the upper surface of deck 30. There preferably is a segmented bead 53 (FIGS. 5-6) on surface 50 that cooperates with bead 48 on lid 38 to hold the lid closed by snap fit, with the axial edge of skirt 46 in abutment with ledge 52. Hinge 40 preferably is of the type illustrated in U.S. Pat. No. 6,041,477. Hinge 40 alternatively, but less preferably, may be of the type illustrated in U.S. Pat. Nos. 4,638,916 and 5,489,035 noted above, or any other suitable single-element or multiple-element type. An array of internal teeth 41 preferably, although not necessarily, extends around the inside of skirt 36 adjacent to the free end of the skirt for cooperating with similar teeth on the container to make the closure non-removable.

Figure 2:
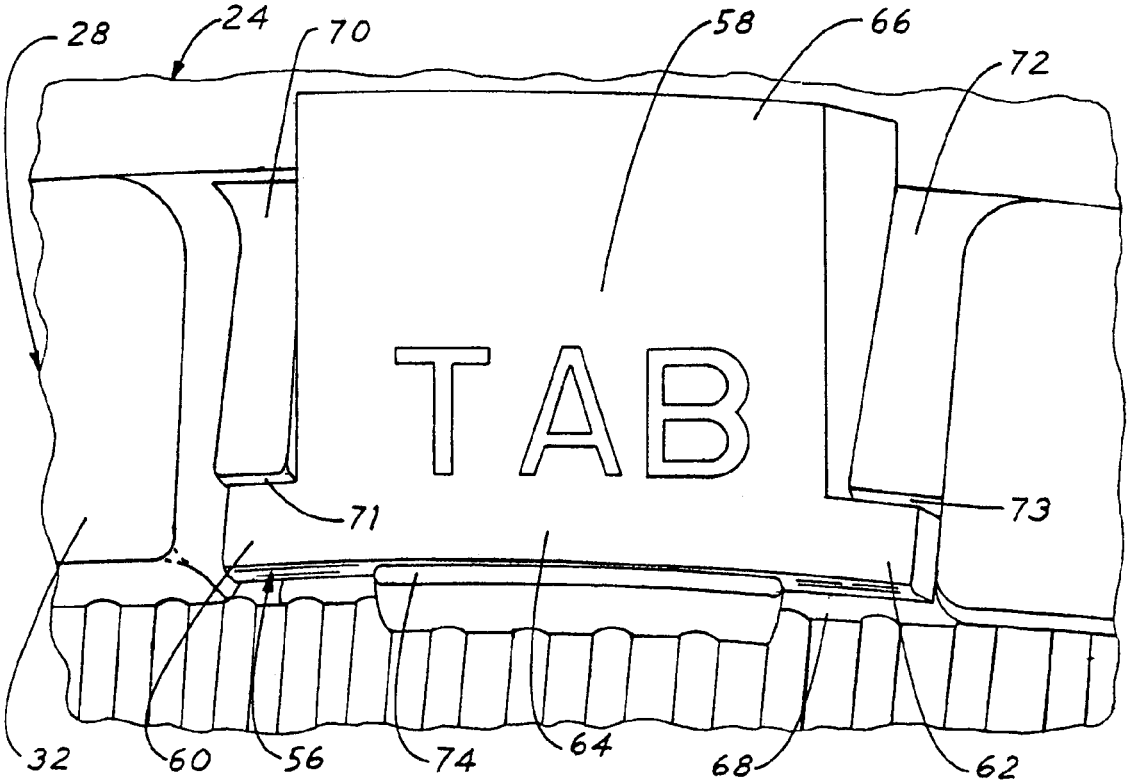
FIG. 2 is a fragmentary perspective view of the closure in the package of FIG. 1.
Figure 3:
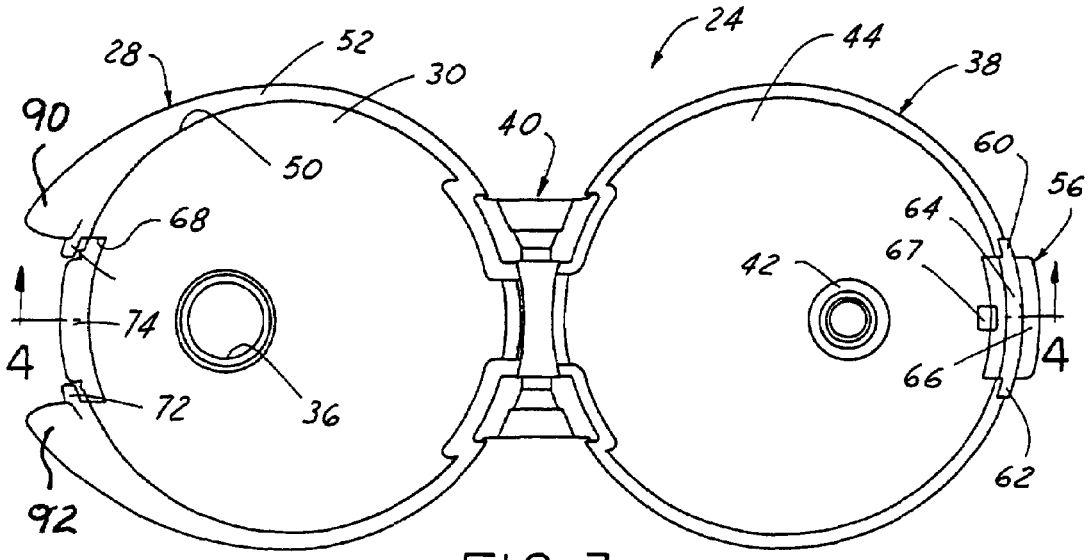
FIG. 3 is a top plan view of the closure in the package of FIG. 1.

In accordance with the embodiment of the invention illustrated in FIGS. 1-8, a latch arm 56 extends from the periphery of lid 38 at a position diametrically opposed to hinge 40. Latch arm 56 preferably is T-shaped as viewed from the radial direction (FIG. 6), having a center leg 58 coupled to and extending axially from the free edge of lid skirt 46 in this embodiment, and having a pair of tabs 60, 62 extending laterally from the free end of leg 58. Tabs 60, 62 are formed in the illustrated embodiment at opposed ends of a bar 64 that extends across the free end of latch leg 58 in a direction parallel to lid base wall 44. Tabs 60, 62 alternatively may extend from the side edges of leg 58, although use of a thickened bar 64 is preferred to strengthen the end of the latch arm. Latch arm 56 is flexibly and resiliently coupled to lid 38 by reason of the flexibility of lid skirt 46. An external bead 66 (FIGS. 3, 6 and 8) extends across leg 58 of latch arm 56 adjacent to the edge of skirt 46 in the preferred embodiments of the invention for engagement by a user's thumb to open the closure, as will be described. As best seen in FIG. 3, latch arm 56, including leg 58 and bar 64, are arcuate as viewed from the axial direction in this embodiment of the invention, following the peripheral contour of lid 38. Tabs 60,62 thus extend circumferentially in this embodiment of the invention, in which base 28 and lid 38 have circular geometries. Base 28 and lid 38 may have other peripheral geometries, such as oval or polygonal. A rib 67 preferably extends axially along the inside surface of lid skirt 46 and latch arm leg 58, circumferentially centered on arm 56 as best seen in FIG. 3, to strengthen the resilient coupling of the latch arm to the lid.

An axial passage 68 extends along the outer surface of base skirt 32 at a position diametrically opposite hinge 40. Passage 68 opens to deck 30 at its upper end, and opens to the radial outer surface of skirt 32. Passage 68 thus in essence comprises a pocket or recess in the outer surface of skirt 32 in this embodiment of the invention, which opens at its upper end to deck 30 of base 28. As best seen in FIG. 3, passage 68 is arcuate as viewed from the axial direction, being contoured to receive latch arm 56 as will be described. A pair of laterally spaced ledges 70, 72 are provided at the laterally or circumferentially opposed edges of passage 68. Each ledge 70, 72 has an associated flat undersurface 71, 73, and a radially outer surface that slopes radially outwardly and axially downwardly in the orientation of FIGS. 4-5. Passage 68 is open behind ledges 70, 72 to permit passage of latch arm 56, as will be described.

As lid 38 is pivoted about hinge 40 from the open position illustrated in FIGS. 3-6 toward the closed position illustrated in FIGS. 1-2, tabs 60, 62 of latch arm 56 engage and slide along the radially outwardly facing surfaces of ledges 70, 72. These outer surfaces, being angulated with respect to the axis of the closure skirt, cam the free end of the latch arm radially outwardly as the lid is closed, resiliently flexing latch arm 56 radially outwardly with respect to the body of lid 38. When tabs 60, 62 reach the lower ends of ledges 70, 72, resiliency of the latch arm and the lid connection snaps tabs 60, 62 radially inwardly beneath undersurfaces 71, 73 of ledges 70, 72 to the fully closed position of the lid illustrated in FIGS. 1 and 2. In this position, leg 58 of latch arm 56 is received between ledges 70, 72 in passage 68, and tabs 60, 62 are captured beneath ledges 70, 72. Lid 38 cannot be opened by simply pulling upwardly on the lid because tabs 60, 62 of latch arm 56 cooperate with ledges 70, 72 in passage 68 to lock the lid in the closed position. A rib 74 preferably, although not necessarily, is provided on the outer surface of skirt 32 immediately beneath passage 68 to help prevent opening of the closure by insertion of a pry tool such as a screwdriver beneath latch arm 56.

Figure 6:
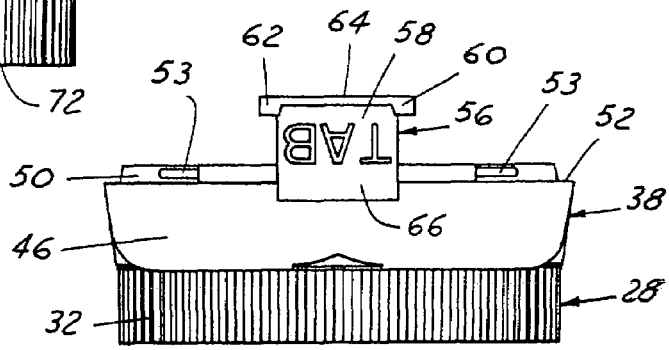

When it is desired to open the lid, a user pushes radially inwardly against the outer surface of latch arm 56, which is exposed between ledges 70, 72 of passage 68. Indicia may be provided on the closure to assist the user, as shown in FIGS. 1, 2 and 6. Arrowhead indicia may also be provided on the upper surface of lid 38, as shown in FIG. 1, to direct a user to the latch arm. When latch arm 56 is pushed radially inwardly into passage 68 to a sufficient extent that tabs 60, 62 clear undersurfaces 71, 73 of ledges 70, 72, the lid may be pushed and pivoted upwardly about hinge 40 to open the closure to dispense product. The back or radially inner surfaces of ledges 70, 72 are spaced from the back or radially inner wall of passage 68 to permit free axial passage of latch arm tabs 60, 62. Release of the latch mechanism and pivotal motion of the lid in this embodiment is a continuous motion that facilitates use by a person who understands operation of the mechanism, but resists opening by a child. Bead 66 on the outer surface of latch arm 56 facilitates upward pushing on the lid when latch arm 56 is depressed.

Figure 4:
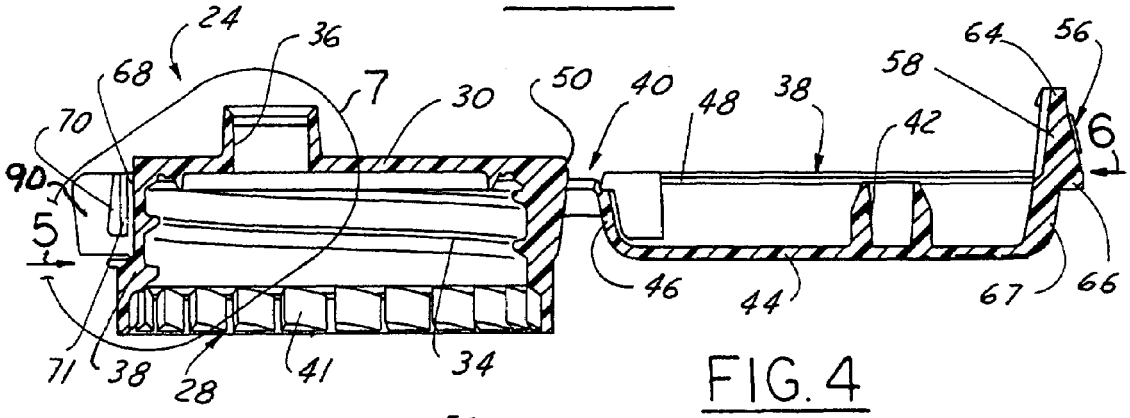
FIG. 4 is a sectional view taken substantially along the line 4-4 in FIG. 3.
Figure 5:
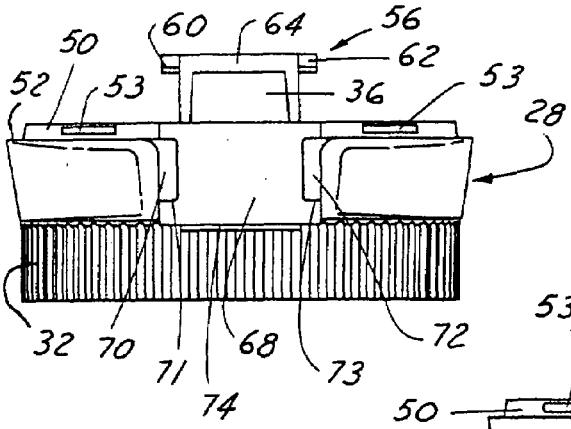
FIGS. 5 and 6 are end elevational views of the closure taken from the respective directions 5 and 6 in FIG. 4.
Figure 7:
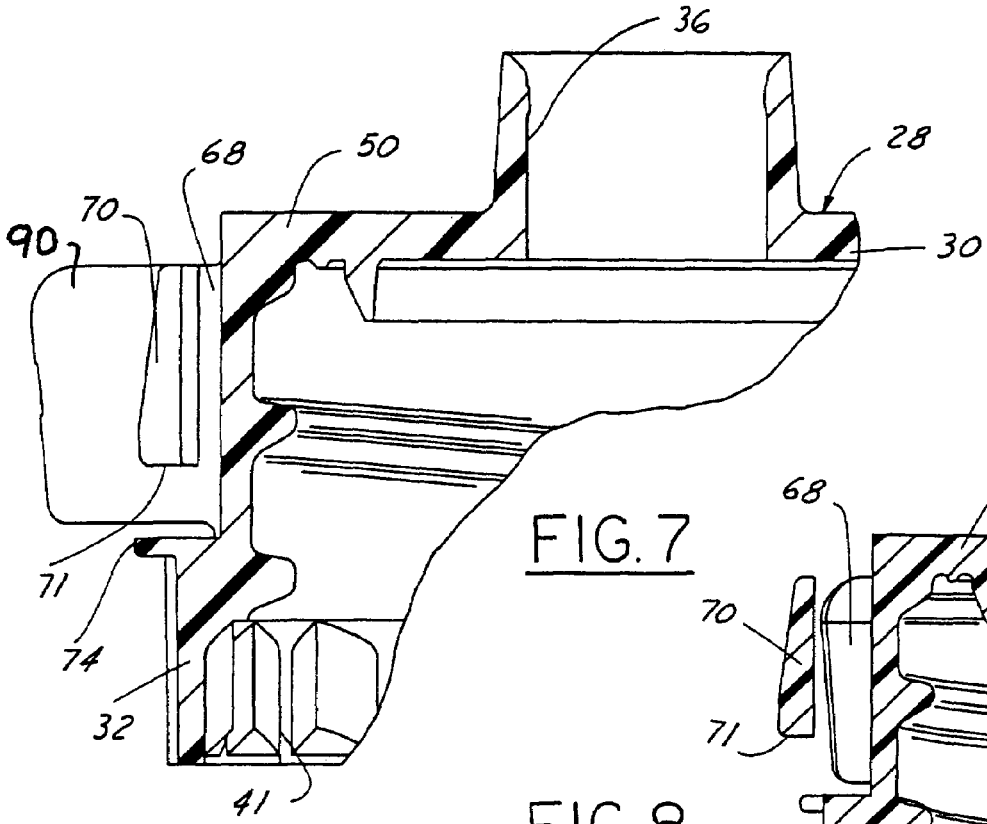
FIG. 7 is a fragmentary sectional view on an enlarged scale of the portion of FIG. 4 within the area 7.
Figure 8:
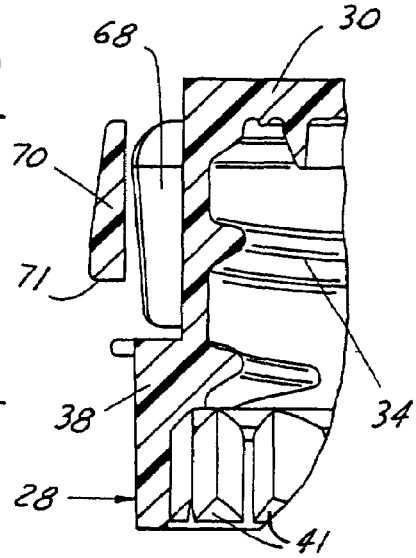
FIG. 8 is an enlargement of a portion of FIG. 7.
Figure 9:
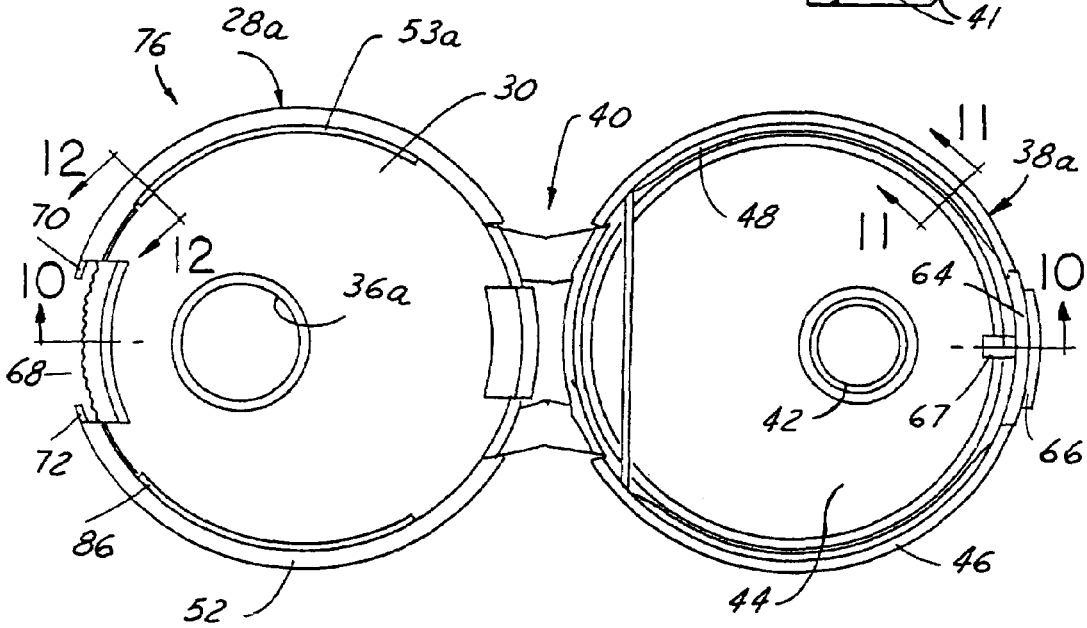
FIG. 9 is a top plan view of a closure in accordance with a modified embodiment of the invention.
Figure 10:
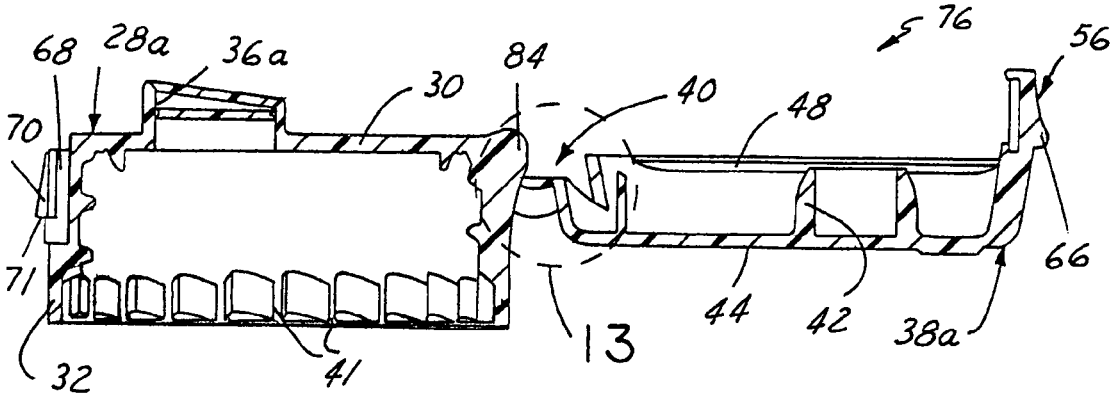
FIGS. 10, 11 and 12 are sectional views taken substantially along the respective lines 10-10, 11-11 and 12-12 in FIG. 9.
Figure 11:
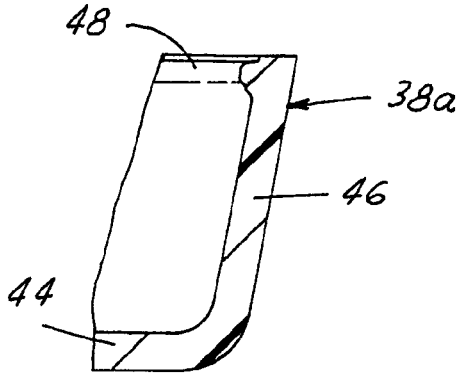
Figure 12:
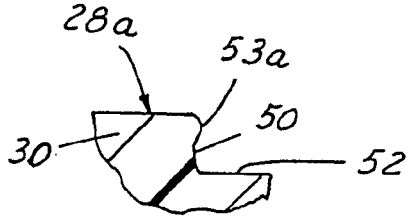
Figure 13:
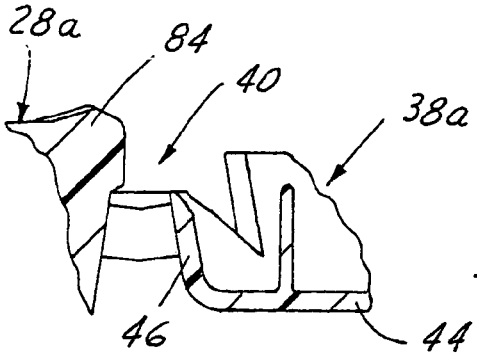
FIG. 13 is a fragmentary sectional view on an enlarged scale of the portion of FIG. 10 within the area 13.

As clearly shown in FIGS. 3, 4 and 7, base 28 and deck 52 extend radially outwardly from skirt 32 to form ribs 90,92 on opposed sides of passage 68. These ribs help protect tab 56 from unintended engagement, such as by a child's teeth. The embodiment of FIGS. 1-8 also has the advantage, as clearly shown in FIG. 1, that the opening-instruction indicia 94 on lid 38 automatically orients a user into alignment with latch arm 56, so that a user will not attempt to open the lid by pressing on hinge 40, for example.

FIGS. 9-13 illustrate a child-resistant dispensing closure 76 in accordance with a modified embodiment of the invention. Elements in FIGS. 9-13 (and FIGS. 14-16) that are identified by reference numerals identical to those employed in FIGS. 1-8 indicate identical or similar components, and related components are designated with a letter suffix. Closure base 28*a* in FIGS. 9-13 includes a raised rib 84 adjacent to hinge 40 to help prevent entry of moisture between base 28*a* and lid 38*a* in the closed position of the lid. Dispensing opening 36*a* in FIGS. 8-13 is formed by an annular wall having an angulated upper edge that helps control dispensing of liquid product from within the package. A bead 53*a* (FIGS. 9 and 12) extends part-way around wall 50 of base 28 and cooperates with bead 48 on skirt 46 of lid 38*a* to snap lid 38*a* in the closed position over base 28*a*.

Figure 14:
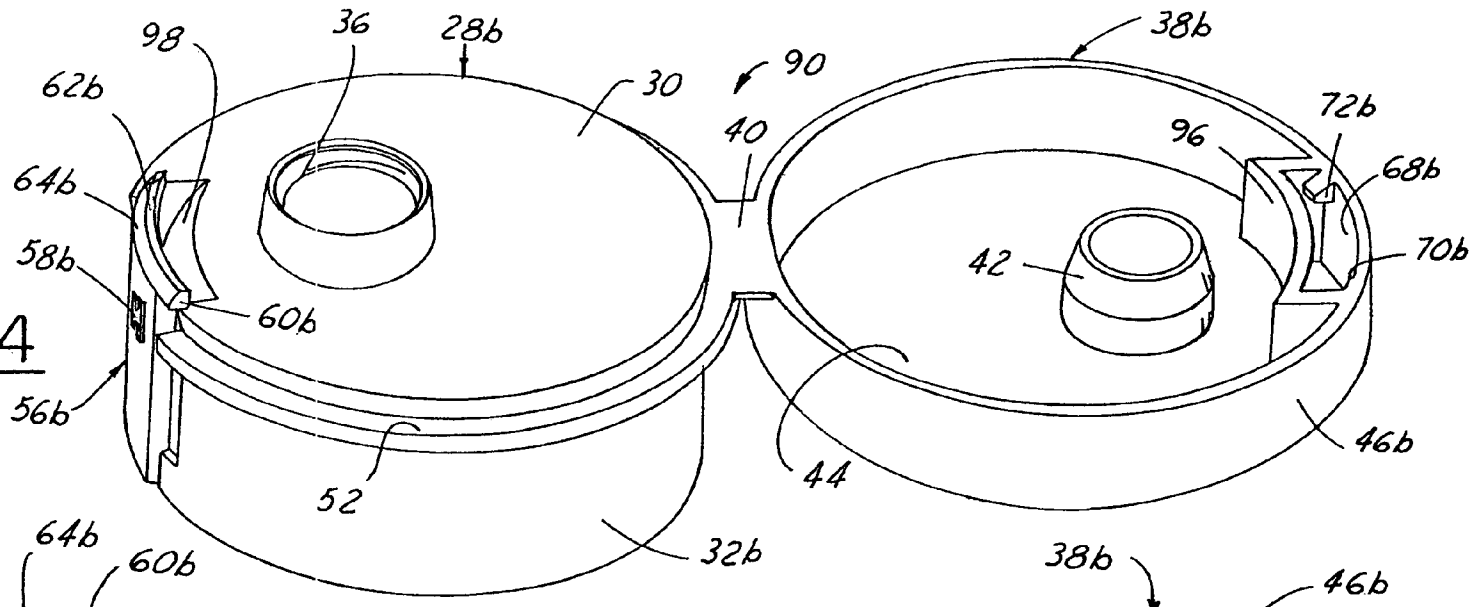
FIG. 14 is a perspective view of a child resistant dispensing closure in accordance with another embodiment of the invention.
Figure 16:
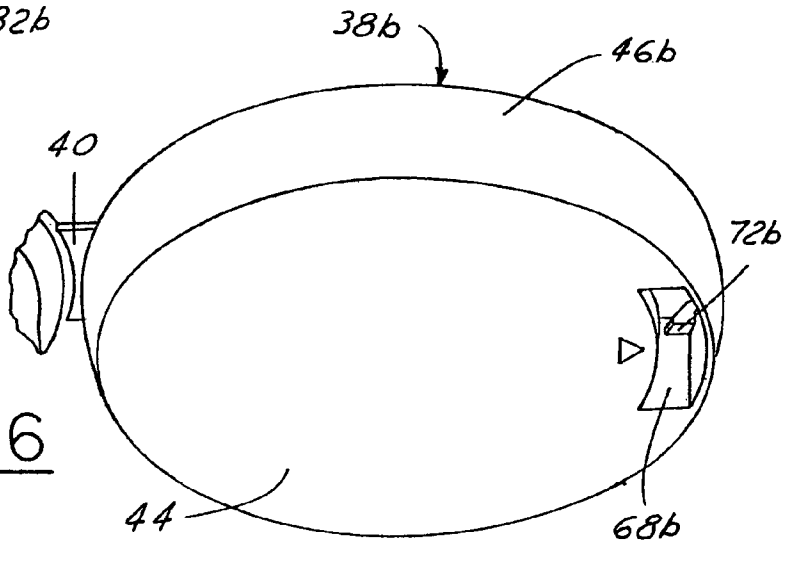
FIGS. 15 and 16 are respective fragmentary perspective views of the base and lid portions of the closure in FIG. 14.
Figure 15:
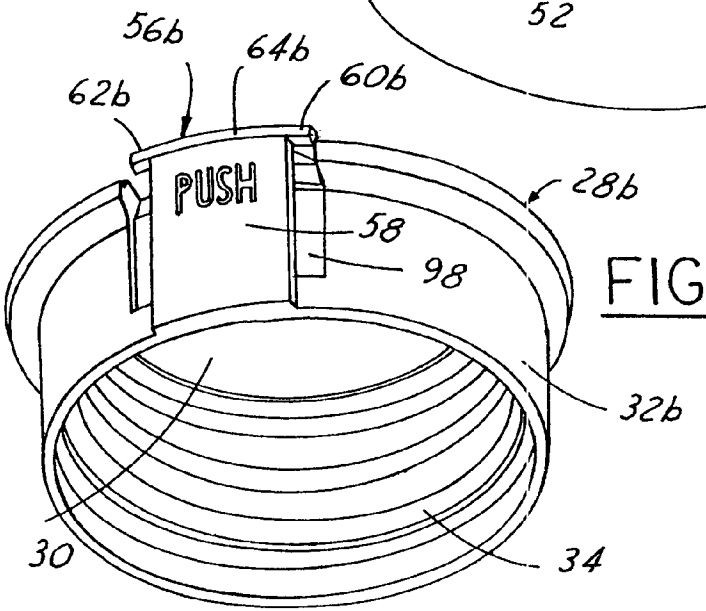

FIGS. 14-16 illustrate a one-piece child-resistant dispensing closure 90 in accordance with another embodiment of the invention as including a base 28*b* integrally molded and connected to a lid 38*b* by means of a hinge 40. A latch arm 56*b* in this embodiment is resiliently coupled to skirt 32*b* of base 28*b* adjacent to the free edge of the skirt 32*b*. Latch arm 56*b* again is T-shaped, having a leg 58*b* coupled to skirt 32*b*, and a pair of laterally extending tabs 60*b*, 62*b* formed by a bar 64*b* that extends across the free edge of leg 58*b*. A passage 68*b* extends axially through the periphery of lid 38*b* at a position diametrically opposite hinge 40. Passage 68*b* has a pair of ledges 70*b*, 72*b* for engagement by tabs 60*b*, 62*b* of latch arm 56*b*. Passage 68*b* in lid 38*b* is radially outwardly enclosed by skirt 46*b* of lid 38*b*, and is radially inwardly enclosed by a wall 96 that limits inward movement of latch arm 56*b*. The radially outwardly directed surface of latch arm bar 64*b* in the embodiment of FIGS. 14-16 is disposed at an angle to the axis of the closure base. Likewise, the axially facing surfaces of ledges 70*b*, 72*b* are disposed at an angle so as to cooperate with the angulated surface of latch arm bar 64*b* resiliently to cam the latch arm radially inwardly as lid 38*b* is closed over base 28*b*. When tabs 60*b*, 62*b* clear ledges 70*b*, 72*b*, the resilient connection between latch arm 56*b* and skirt 32*b* snaps the latch arm radially outwardly so that tabs 60*b*, 62*b* overlie opposing flat upper surfaces on ledges 70*b*, 72*b* to lock the lid in the closed position. To open the lid, latch arm 56*b* is pushed radially inwardly until tabs 60*b*, 62*b* clear ledges 70*b*, 72*b*, at which point lid 38*b* may be pivoted from the closed position toward the open position for dispensing product from within the package. Base skirt 32*b* has an open pocket 98 behind latch arm 56*b* to permit such inward flexing of the latch arm.

There have thus been disclosed a child-resistant closure, and a child-resistant closure and container package that fully satisfy all of the objects and aims previously set forth. The closure has been disclosed in conjunction with three presently preferred embodiments thereof, and a number of modifications and variations have been discussed. Other modifications and variations will readily suggest themselves to persons of ordinary skill in the art. The invention is intended to embrace all such modifications and variations as fall within the spirit and broad scope of the appended claims.

The invention claimed is:

1. A child-resistant closure that includes:

a base having a dispensing opening and a peripheral skirt, a lid molded integrally with said base end coupled by a hinge to said base so as to be pivotable about said hinge between a closed position adjacent to said dispensing opening and an open position spaced from said dispensing opening, one of said base and said lid having a latch arm resiliently extending from a periphery thereof diametrically opposite said hinge, said latch arm having a pair of opposite extending tabs adjacent to a free end thereof, the other of said base and said lid having an axial passage for receiving said latch arm and a pair of laterally spaced ledges in said passage for engagement by said tabs to lock said lid in said closed position, said latch arm being directly manually engageable by a user from a radial direction external to said closure to pivot said latch arm radially inwardly within said passage and release said tabs from said ledges so that said lid can be pivoted to said open position, and cam surfaces on said ledges, said tabs on said latch arm, or both said ledges and said tabs, for flexing said resilient latch arm to snap said tabs over said ledges as said lid is pivoted to said closed position.

2. The closure set forth in claim 1 wherein said latch arm resiliently extends from a periphery of said lid diametrically opposite said hinge, and wherein said passage in said base is radially open at said skirt.

3. The closure set forth in claim 2 wherein said ledges in said passage radially open at said skirt such that said latch arm may extend outside of said skirt as said lid is moved toward said closed position and then snap radially inwardly beneath said ledges due to resilience of said latch arm and connection between said latch arm and said lid.

4. The closure set forth in claim 3 wherein said lid includes an internal rib on said latch arm for strengthening resilient coupling of said latch arm to said lid.

5. A child-resistant dispensing closure that includes:

a base having a deck with a dispensing opening and a peripheral skirt extending from said deck, a lid molded integrally with said base and coupled by a hinge to a periphery of said base so as to be pivotable about said hinge between a closed position overlying said deck and an open position spaced from said deck, a latch arm resiliently coupled to a periphery of said lid diametrically opposite said hinge, said latch arm being T-shaped having a center leg coupled to said lid and a pair of tabs extending laterally oppositely from a free end of said leg, and an axial passage on said base for receiving said latch arm, said passage being radially open at said skirt and having a pair of laterally spaced ledges for engagement by said tabs to look said lid in said closed position, said latch arm being directly manually engageable by a user from a radial direction external to said base to flex said latch arm radially inwardly into said passage and release said tabs from engagement with said ledges so that said lid can be pivoted to said open position.

6. The closure set forth in claim 5 wherein said ledges in said passage radially open at said skirt such that said latch arm may extend outside of said skirt as said lid is moved toward said closed position and then snap radially inwardly beneath said ledges due to resilience of said latch arm and connection between said latch arm and said lid.

7. The closure set forth in claim 6 further comprising cam surfaces on said skirt adjacent to said open passage in said skirt for engagement by said tabs on said latch arm to cam said latch arm radially outwardly as said lid is pivoted toward said closed position.

8. The closure set forth in claim 7 wherein said lid includes an internal rib on said latch arm for strengthening resilient coupling of said latch arm to said lid.

9. A child-resistant closure and container package that includes:

a container and a closure secured to said container, said closure comprising:

a base having a deck with a dispensing opening and a peripheral skirt extending from said deck, a lid molded integrally with said base and coupled by a hinge to a periphery of said base so as to be pivotable about said hinge between a closed position overlying said deck and an open position spaced from said deck, one of said base and said lid having a latch arm resiliently extending from a periphery thereof diametrically opposite said hinge, said latch arm having a pair of opposite extending tabs adjacent to a free end thereof, the other of said base and said lid having an axial passage for receiving said latch arm and a pair of laterally spaced ledges in said passage for engagement by said tabs to look said lid in said closed position, said latch arm being directly manually engageable by a user from a radial direction external to said closure to pivot said latch arm radially inwardly within said passage and release said tabs from said ledges so that said lid can be pivoted to said open position.

10. The package set forth in claim 9 wherein said latch arm resiliently extends from a periphery of said lid diametrically opposite said hinge, and wherein said passage in said base is radially open at said skirt.

11. The package set forth in claim 10 wherein said ledges in said passage radially open at said skirt such that said latch arm may extend outside of said skirt as said lid is moved toward said closed position and then snap radially inwardly beneath said ledges due to resilience of said latch arm and connection between said latch arm and said lid.

12. The package set forth in claim 11 further comprising cam surfaces on said ledges adjacent to said open passage in said skirt for engagement by said tabs on said latch arm to cam said latch arm radially outwardly as said lid is pivoted toward said closed position.

13. The package set forth in claim 11 wherein said lid includes an internal rib on said latch arm for strengthening resilient coupling of said latch arm to said lid.

14. The package set forth in claim 10 further comprising cam surfaces on said ledges, said tabs on said latch arm, or both, for flexing said resilient latch arm to snap said tabs over said ledges as said lid is pivoted toward said closed position.

15. A child-resistant closure and container package that includes:

a container and a closure secured to said container, said closure comprising:

a base having a deck with a dispensing opening and a peripheral skirt extending from said deck, a lid molded integrally with said base and coupled by a hinge to a periphery of said base so as to be pivotable about said hinge between a closed position overlying said deck and an open position spaced from said deck, a latch arm resiliently coupled to a periphery of said lid diametrically opposite said hinge, said latch arm being T-shaped having a center leg coupled to said lid and a pair of tabs extending laterally oppositely from a free end of said leg, and an axial passage on said base for receiving said latch arm, said passage being radially open at said skirt and having a pair of laterally spaced ledges for engagement by said tabs to lock said lid in said closed position, said latch arm being directly manually engageable by a user from a radial direction external to said base to flex said latch arm radially inwardly into said passage and release said tabs from engagement with said ledges so that said lid can be pivoted to said open position.

16. The package set forth in claim 15 wherein said ledges in said passage radially open at said skirt such that said latch arm may extend outside of said skirt as said lid is moved toward said closed position and then snap radially inwardly beneath said ledges due to resilience of said latch arm and connection between said latch arm and said lid.

17. The package set forth in claim 16 further comprising cam surfaces on said skirt adjacent to said open passage in said skirt for engagement by said tabs on said latch arm to cam said latch arm radially outwardly as said lid is pivoted toward said closed position.

18. The package set forth in claim 17 wherein said lid includes an internal rib on said latch arm for strengthening resilient coupling of said latch arm to said lid.

19. The closure set forth in claim 1 wherein said base has ribs that extend radially outwardly from said skirt on opposed sides of said passage.

20. The closure set forth in claim 2 including indicia on said lid pointing to and aligned with said latch arm to instruct a user to engage said latch arm.

21. A child-resistant closure that includes:

a base having a dispensing opening and a peripheral skirt, a lid molded integrally with said base and coupled by a hinge to said base to be pivotable around said hinge between a closed position adjacent to said dispensing opening and an open position spaced from said dispensing opening, a latch arm having a first end resiliently coupled to one of said base and said lid opposite said hinge, said latch arm extending from said first end to a second end that is wider than said first end, the other of said base and said lid having an axial passage for receiving said latch arm, a pair of ledges in said passage for engagement by said latch arm to lock said lid in said closed position, and radially facing angulated cam surfaces on said ledges, pivotal movement of aid lid toward said closed position bringing said second end of said latch arm into engagement with said cam surfaces, resiliently flexing said latch arm radially until said second end of said latch arm registers with said ledges, whereupon resiliency of said latch arm snaps said latch arm between said ledges, said latch arm being directly manually engageable by a user from a radial direction external to said closure to pivot said latch arm radially inwardly within said passage and release said latch arm from said ledges so that said lid can be pivoted toward said open position.

22. The closure set forth in claim 21 wherein said latch arm has a pair of laterally extending tabs adjacent to said second end for engagement with said cam surfaces as said lid is closed and for snap receipt over said ledges in said closed position of said lid.

* * * * *